US007753169B1

(12) United States Patent
Kurtz

(10) Patent No.: US 7,753,169 B1
(45) Date of Patent: Jul. 13, 2010

(54) WHEELED SUPPORT PLATFORM FOR A STEPLADDER

(76) Inventor: Jeffrey A. Kurtz, P.O. Box 50394, Fort Myers, FL (US) 33994

( * ) Notice: Subject to any disclaimer, the term of this patent is extended or adjusted under 35 U.S.C. 154(b) by 357 days.

(21) Appl. No.: 11/589,430

(22) Filed: Oct. 30, 2006

(51) Int. Cl.
*E04G 1/30* (2006.01)

(52) U.S. Cl. ..... 182/17; 182/129

(58) Field of Classification Search ..... 182/180.2, 182/129, 17; 280/35
See application file for complete search history.

(56) References Cited

U.S. PATENT DOCUMENTS 2,743,049 A * 4/1956 Flesher ..... 182/176
2,798,652 A * 7/1957 Easton ..... 182/17
3,490,558 A * 1/1970 Foley ..... 182/103
4,408,680 A * 10/1983 Ross ..... 182/68.1
5,228,534 A * 7/1993 Haroldson, Sr. ..... 182/63.1
5,411,111 A * 5/1995 Greve ..... 182/17
5,551,528 A * 9/1996 Vieito ..... 182/129
6,053,284 A * 4/2000 Fountain ..... 182/180.2
6,095,533 A * 8/2000 Balolia ..... 280/35
6,109,628 A * 8/2000 Scheper ..... 280/47.35
6,283,249 B1 * 9/2001 Young et al. ..... 182/17
7,163,214 B1 * 1/2007 Bratton, Sr. ..... 280/79.11
2001/0047905 A1 * 12/2001 Boyer ..... 182/15

* cited by examiner

*Primary Examiner*—Alvin C Chin-Shue
(74) *Attorney, Agent, or Firm*—William E. Noonan

(57) ABSTRACT

A wheeled platform for supporting a stepladder includes an adjustable size frame carrying a plurality of swivelable and rotatable wheels for movably interengaging an underlying surface. The frame includes a plurality of adjustable mounting brackets that are releasably interconnectable to respective legs of a stepladder for holding the stepladder in an open condition on the frame. A brake is provided for selectively engaging at least one of the wheels to brake and hold the frame in a selected location on the underlying surface.

3 Claims, 6 Drawing Sheets

WHEELED SUPPORT PLATFORM FOR A STEPLADDER

FIELD OF THE INVENTION

This invention relates to a wheeled platform for supporting a stepladder and, more particularly, to a platform that allows a stepladder to be conveniently maneuvered and moved between selected locations without the user having to fold, carry and unfold the ladder. The wheeled platform is adjustable to accommodate various sizes of stepladders.

BACKGROUND OF THE INVENTION

Stepladders are used for a virtually endless variety of business, commercial, household and home improvement purposes. In many instances, such as, for example, painting, carpentry, changing light bulbs and servicing fire alarms, the ladder must be repeatedly moved and repositioned. This procedure tends to be tedious and time consuming and often requires considerable physical effort. First, the person using the ladder must descend the ladder. Then, the stepladder must be folded and manually carried to the new location. After the stepladder is set-up at this new location, the user must again climb the ladder to perform the desired task or operation. Not only does this procedure take a substantial amount of time, it can be physically demanding. The availability of relatively lightweight ladders has reduced the physical effort somewhat. However, moving and re-deploying a stepladder remains, at best, a very tedious task. In many cases, the necessary physical effort is compounded because the user is carrying a heavy tool belt around his or her waist. At the very least, the tools being used must be retrieved and moved to the new location. This contributes to the time, effort and ultimately the expense of performing the task for which the ladder is required. Manually moving and repositioning a stepladder can contribute to worker injuries and increased costs associated with such injuries.

SUMMARY OF THE INVENTION

It is therefore an object of the present invention to provide a wheeled platform for supporting a stepladder so that the ladder may be moved and repositioned quickly, conveniently and virtually effortlessly between selected locations.

It is a further object of this invention to provide an apparatus that enables the user to maneuver and reposition a stepladder while remaining on the ladder so that considerable time, tedium and effort are saved.

It is a further object of this invention to provide a wheeled, ladder-supporting platform that conveniently supports a worker's tools so that the worker does not have to manually and laboriously carry those tools between successive work locations.

It is a further object of this invention to provide a wheeled, ladder-supporting platform that holds a worker's tools so that they are conveniently transportable between successive locations and readily accessible to the worker when needed.

It is a further object of this invention to provide a wheeled platform for a stepladder, which allows the ladder to be positionally maneuvered while the user remains standing on the ladder and which, therefore, saves considerable time in performing repetitive tasks at successive locations.

It is a further object of this invention to provide a wheeled platform for supporting various sizes of stepladders.

It is a further object of this invention to provide a wheeled platform for a stepladder, which eliminates the time, tedium and physical effort required to move a ladder between successive selected locations.

It is a further object of this invention to provide a wheeled platform for supporting a stepladder, which reduces the physical effort normally needed to manually move the ladder, as well as the risk of injury and costs associated therewith.

It is a further object of this invention to provide a wheeled platform for stepladders, which may be used conveniently by workers in a variety of building trades, as well as by various other industries (i.e. warehouses and storage facilities) and by private homeowners.

It is a further object of this invention to provide a wheeled platform for supporting a stepladder, which is extremely lightweight and maneuverable, yet durable, strong and safe to use.

This invention features a wheeled platform for supporting a stepladder. The platform includes a frame carrying a plurality of mounting brackets for attaching respective legs of a stepladder to the frame. A plurality of wheels are rotatably and swivelably mounted to and depend from the frame. The wheels are rotatably engagable and with underlying surface for moving the frame and a ladder supported by the frame along the underlying surface. There is a brake selectively engagable with at least one of the wheels for braking movement of the frame along the underlying surface.

In a preferred embodiment, the frame has a rectangular shape and is adjustable in size to accommodate selected sizes of ladders. The frame may include forward and rearward sections and a pair of side sections that interconnect the forward and rearward sections. The forward section may carry a pair of brackets for interconnecting to respective forward legs of a stepladder. The rearward section may similarly include a pair of brackets for attaching to respective rearward legs of the ladder. Each of the brackets may be positionally adjusted along its respective forward or rearward section for engaging a respective leg of the ladder. Each bracket may include a plate that is mounted on the associated frame section. Each plate may include one or more longitudinal slots that receive associated positioning bolts that are in turn engaged with the associated frame element. The brackets slide longitudinally along the frame element such that the bolts slide relatively within the slots. Each bracket further includes an upwardly turned flange attached to an outer end of the plate. Each bracket is adjusted by sliding the plate along the underlying frame section until the flange engages an outside surface of a respective ladder leg. Each ladder leg may include a hole that corresponds and aligns with a hole in the flange. A nut and bolt or other means of connection may be engaged with the aligned holes to secure the leg or the ladder to the respective bracket. Each of the four legs of a standard stepladder may be secured to a respective bracket in the foregoing manner.

The side sections of the frame may include at least a pair of elongate, telescopically interengaged members. Each of the side sections may include a relatively large diameter tube attached to one of the forward and rearward sections and a relatively small diameter tube attached to the other of the forward and rearward frame sections. The large diameter tubes receive the small diameter tubes telescopically such that the forward and rearward frame sections may be adjusted toward and away from each other. This allows the frame to accommodate various sizes (e.g. heights) of stepladders. Locking pins may be utilized to fasten the telescopically interconnected side sections in selected positions.

A pan or base may be carried by the frame. Typically, the base is attached to and extends between the large diameter tubes of the side frame sections. The side frame sections may feature square tubing. The forward and rearward frame sections may also include square tubing. The wheels may include four casters, which are carried at respective corners of the rectangular frame. Each caster wheel may be supported by a bracket that is mounted to and extends outwardly from the frame.

DETAILED DESCRIPTION OF PREFERRED EMBODIMENTS

Other objects, features and advantages will occur from the following description of a preferred embodiment and the accompanying drawings, in which.

Figure 1:
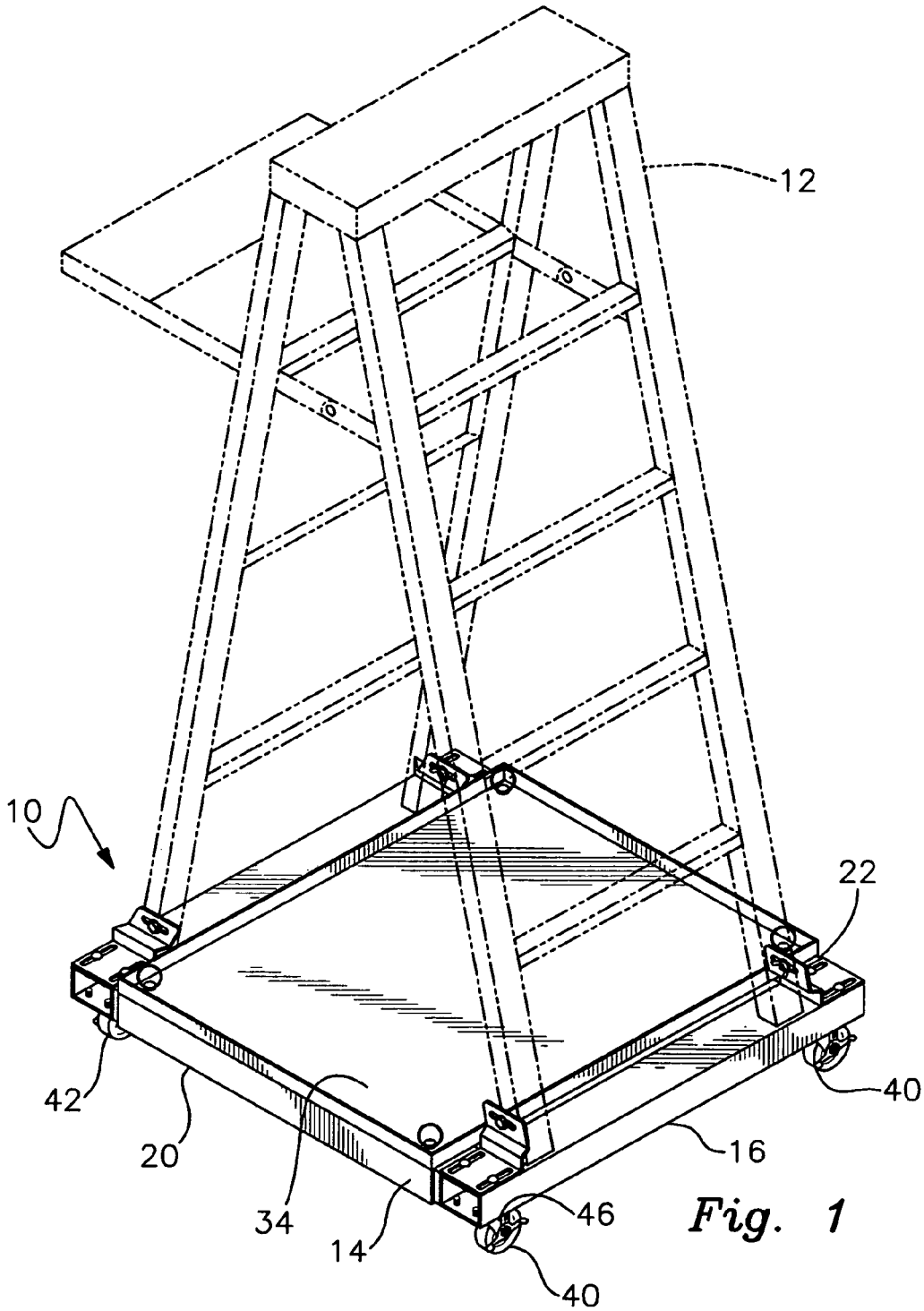
FIG. 1 is a perspective view of the wheeled platform of this invention with a standard stepladder mounted thereon.
Figure 2:
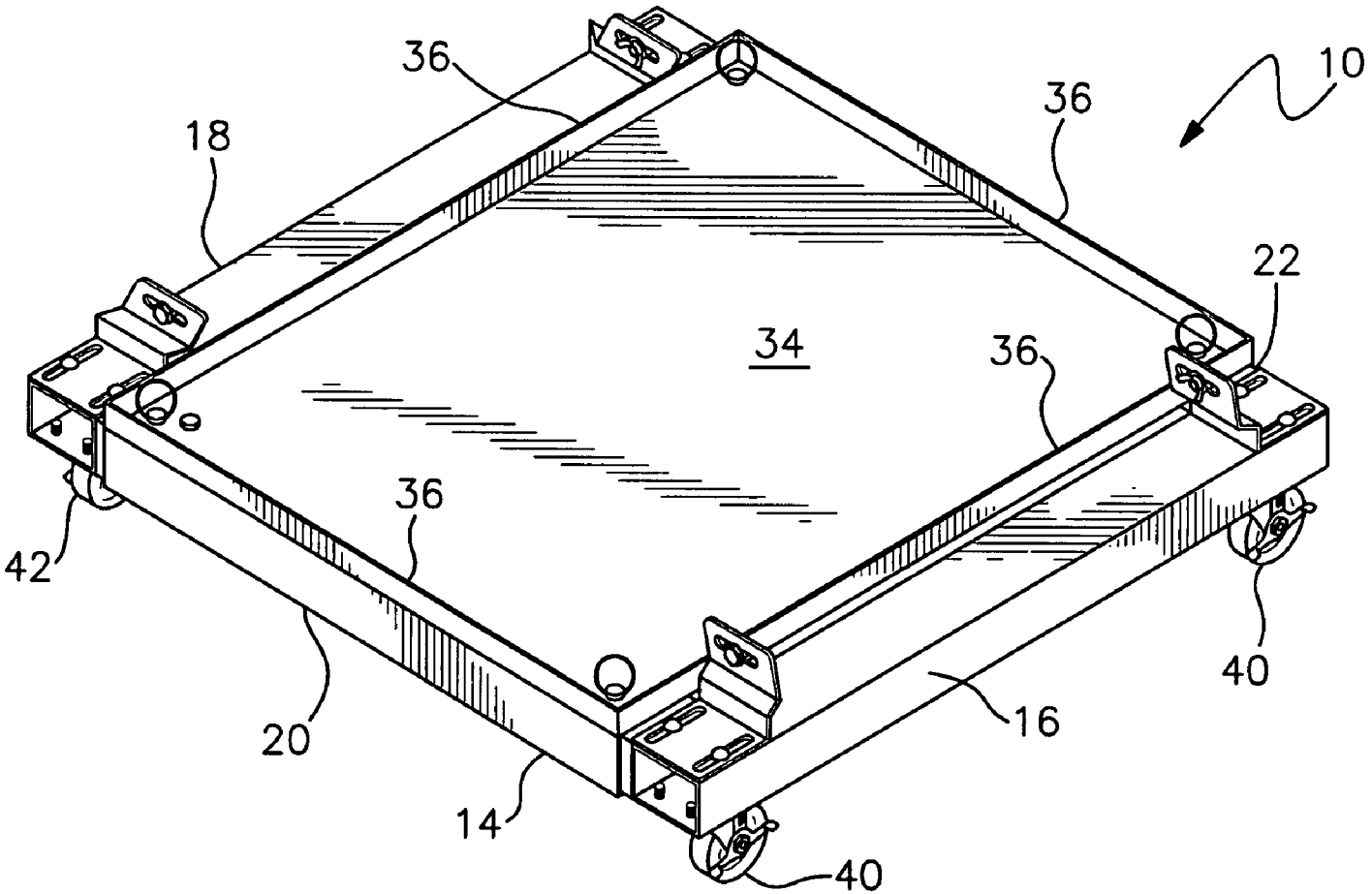
FIG. 2 is a perspective view of the wheeled platform by itself.
Figure 3:
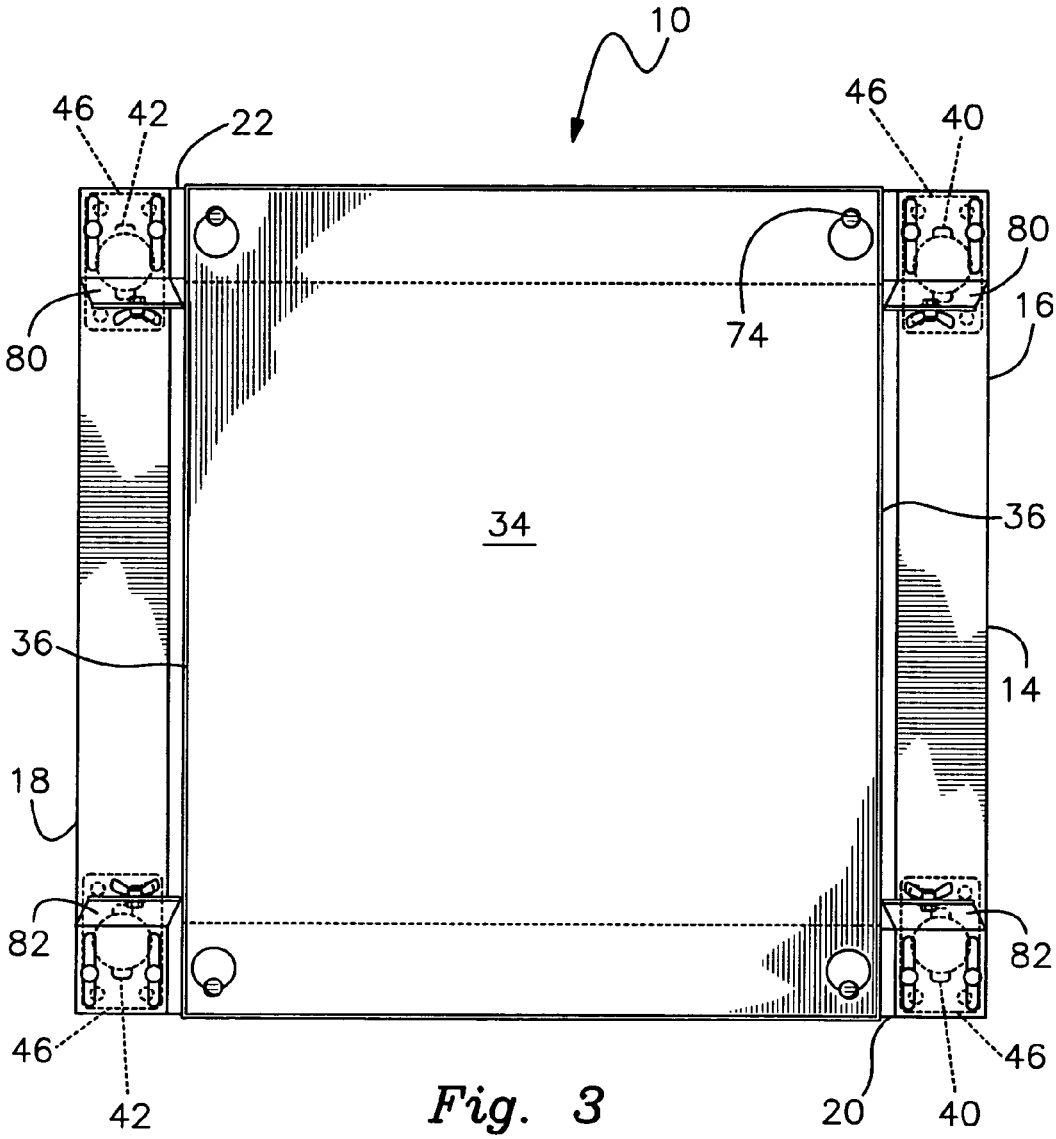
FIG. 3 is a top plan view of the platform.

There is shown in FIGS. 1-3 a wheeled platform 10 for supporting a stepladder 12 (shown specifically in FIG. 1). Platform 10 is suitable for accommodating assorted sizes and types of stepladders. The particular variety of stepladder that may be supported using the wheeled platform is not a limitation of this invention. Nonetheless, in most cases, the stepladder will comprise a lightweight metal or metal alloy such as aluminum. Alternatively, the stepladder may comprise other materials such as fiberglass or wood. As is described more fully below, platform 10 is designed for virtually an endless multitude of uses including, without limitation, commercial, business, industrial, home and personal applications.

Figure 4:
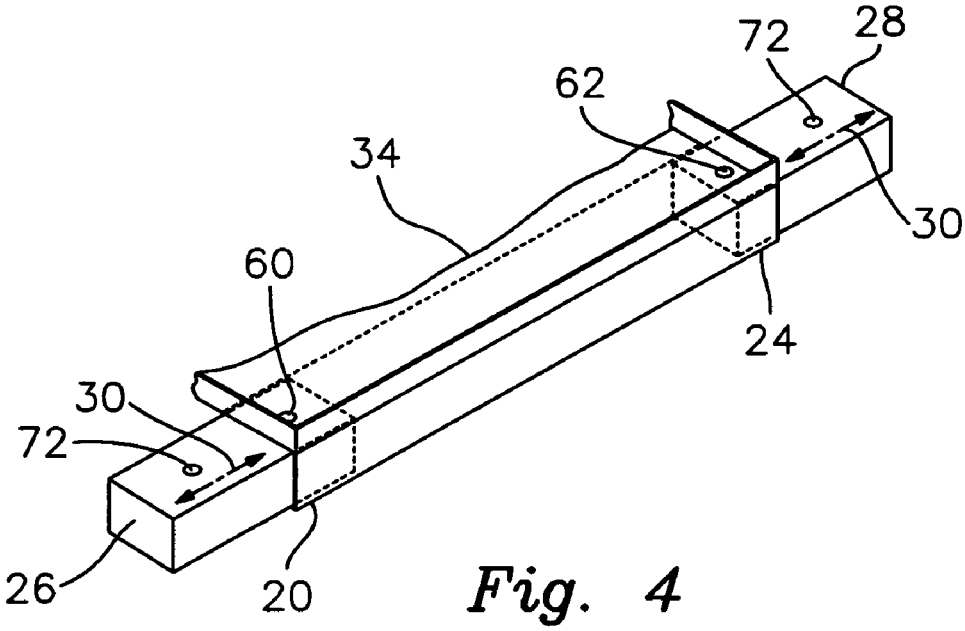
FIG. 4 is a fragmentary perspective view of a representative one of the side sections of the frame and specifically depicting the telescopically interengaged frame elements.

Platform 10 features an adjustable rectangular frame 14 that is preferably composed of steel, aluminum or other durable and relatively high-strength materials. The rectangular frame includes elongate and substantially parallel forward and rearward sections 16 and 18, respectively. Each of the forward and rearward sections preferably comprises an elongate piece of square tubing. An elongate pair of substantially parallel side sections 20 and 22 interconnect front and rear sections 16 and 18 at respective ends thereof. A representative one of the side sections (i.e. section 20) is shown in FIG. 4. Each side section includes a centrally disposed outer tube 24 (which again preferably comprises a square tube) and a pair of smaller diameter inner tubes 26 and 28 that are telescopically interengaged with respective ends of outer tube 24. Each of the tubes 26 and 28 has an exterior diameter (e.g. height and width) that is less than the interior diameter (corresponding interior height and width) of tube 24. As a result, each of the tubes 26 and 28 is receivable in a respective end of tube 24 and longitudinally adjustable therein, as indicated by double-headed arrows 30. This enables the side sections of the frame to be adjusted for accommodating different sizes of stepladders in a manner that is described more fully below. In alternative versions, inner tubes 26, 28 may receive outer tube 24. Other length adjustable constructions may be utilized.

Each of the inner tubes 26 and 28 flushly interengages a corresponding end of a respective forward or rearward section 16, 18. The front and back sections 16 and 18 are joined to the side sections 20 and 22 along such joints and are secured together by welding or other appropriate fastening means.

A pan, tray or base 34 is mounted to frame 14 and, in particular, is secured to and extends between side sections 20 and 22. Base 34 is again composed of a durable metal such as aluminum or steel. As best shown in FIG. 3, the pan extends fully across the upper surfaces of sections 20 and 22. More particularly, the base is secured to the upper surfaces of respective square outer tubes 24. The base is attached to each outer tube by bolts, welding or other suitable means of attachment. Base 34 includes an upperwardly turned lip 36 that extends peripherally about the base. The base is suitable for supporting various accessories such as paint cans, light bulbs, fire alarms, etc. The upwardly turned lips help to retain such items on the base so that they can be conveniently moved on platform 10 along with the ladder that the platform supports.

Figure 5:
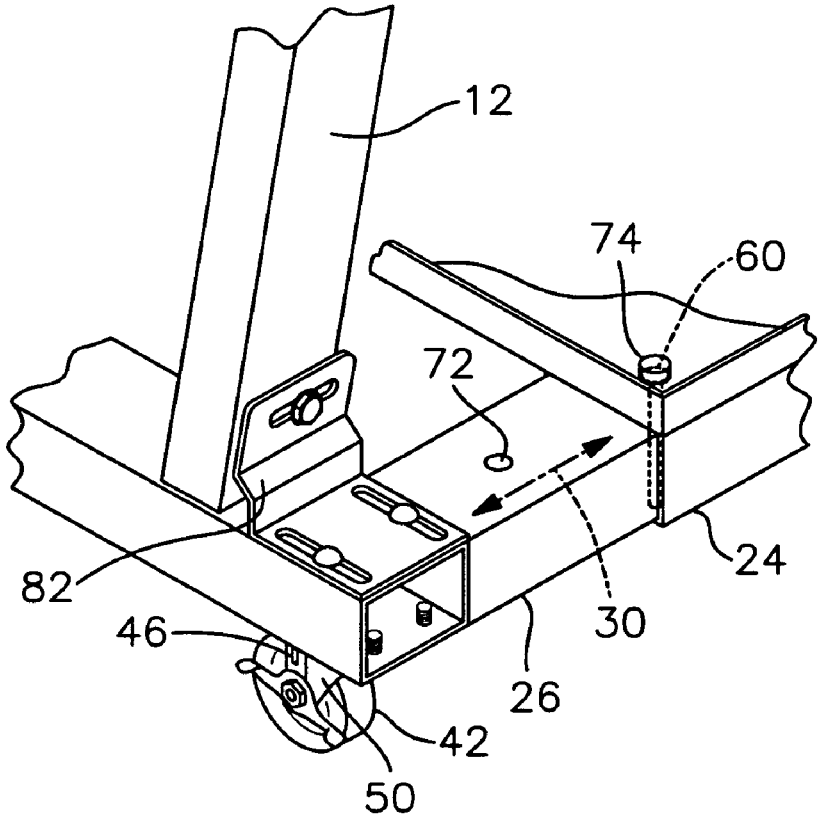
FIG. 5 is a perspective view of one corner of the platform with a stepladder mounted thereon.
Figure 9:
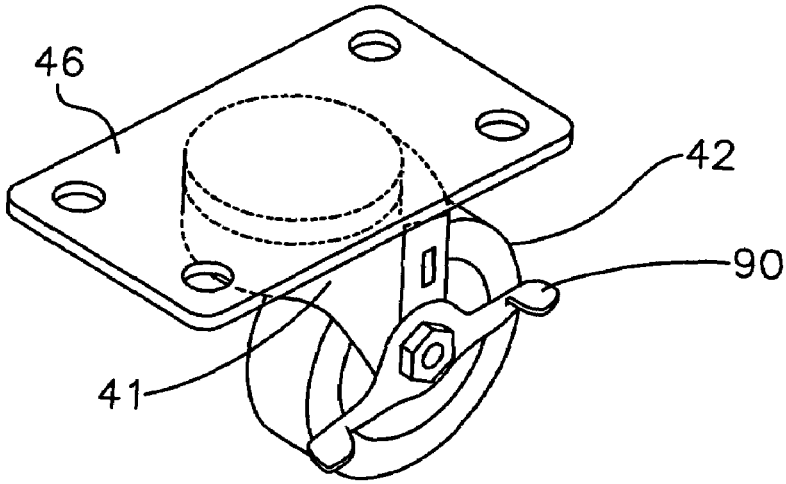
FIG. 9 is a perspective view of one of the caster wheels with a braking mechanism attached thereto.

Frame 14 carries four caster-type wheels, which are swivelably attached to and depend from respective corners of the frame. More particularly, a pair of front wheels 40 are mounted to the frame proximate respective ends of front frame section 16. A pair of rearward wheels 42 are similarly secured to the frame proximate respective ends of rearward section 18. Each wheel comprises a caster-like construction. A mounting bracket 46, shown in FIGS. 5 and 9, is secured to frame 14 and, more particularly, to a bottom surface of a respective square tube 16, 18 proximate one end thereof. This positions brackets 46 proximate the four corners of the rectangular frame and pointed downwardly from those corners as best shown in FIG. 3. Each bracket 46 is welded, bolted or otherwise secured to the frame. A respective wheel is rotatably and swivelably secured to each bracket in a conventional manner (e.g. by a yoke 50 depending from the bracket). Indeed, each of the forward and rearward wheels 42 may comprise a conventional caster wheel construction and the wheel units may be purchased as "off the shelf" items. Alternatively, they may be custom manufactured for the platform of this invention. In any case, each wheel 40, 42 should be freely rotatable within a respective yoke 50 and swivelable with respect to its supporting bracket 46. As a result, platform 10 is supported above an underlying surface (e.g. a floor, pavement or other fairly level surface) and the wheeled platform is readily maneuverable about that underlying surface.

Figure 6:
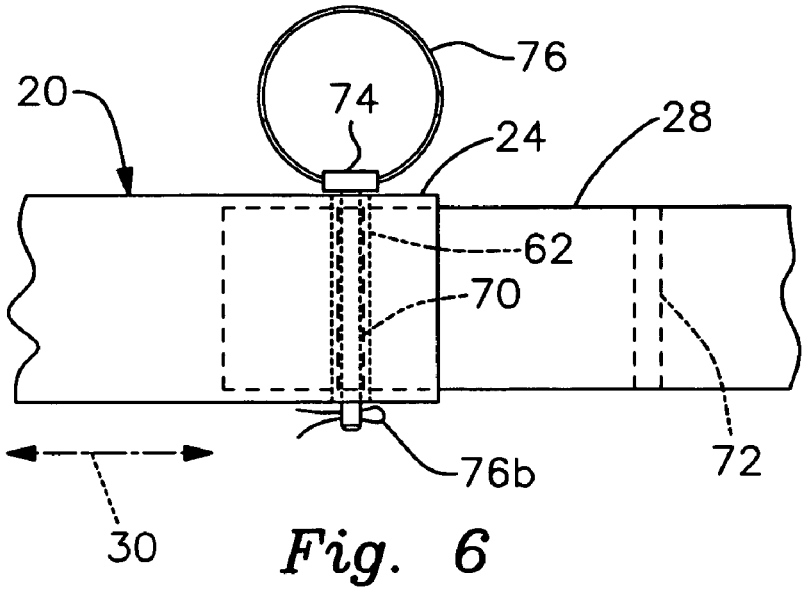
FIG. 6 is an elevational view of a pair of telescopically interengaged side frame elements with a locking pin interconnecting those elements and maintaining the frame in a selected size.

Frame 14 is selectively expandable and contractible for accommodating various sizes of stepladders. Size adjustment of the frame is accomplished by longitudinally adjusting the effective lengths of side sections 20 and 22. The details of such adjustment are best depicted in FIGS. 4-6. As previously described, outer tube 24 of each side section 20, 22, telescopically receives a pair of inner tubes 26 and 28, which are longitudinally slidable within tube 24 as indicated by double-headed arrows 30. The inner and outer tubes include respective sets of alignable adjustment holes and locking pins that are employed to secure the side sections of the frame in a selected position to provide a corresponding desired length. For example, outer tube 24 includes a left-hand position adjustment hole 60 and a right-hand position adjustment hole 62. Each of the inner tubes 26 and 28 includes a longitudinally spaced apart pair of adjustment holes 70 and 72. Hole 70 is formed vertically through each inner tube 26, 28 proximate the distal or inner end of the tube. Each position adjustment hole 72 is formed vertically through each inner tube at a spaced apart location closer to the proximal or outer end of the inner tube. In FIG. 4, the distal adjustment holes of inner tubes 26 and 28 are in general alignment with adjustment holes 60 and 62 of outer tube 24 and are effectively obscured by the outer tube. This is similarly the case in FIG. 5. In FIG. 6, the distal adjustment hole 70 of inner tube 28 is depicted in phantom aligned with the right-hand position adjustment hole 62 of outer tube 24.

By longitudinally adjusting side sections 20 and 22 in the previously described manner and aligning the respective position adjustment holes as required, the size of the frame may be adjusted to accommodate various sizes of ladders. The largest frame size is achieved by adjusting each side section 20, 22 in the following manner. Inner tubes 26 and 28 are slid outwardly from respective ends of outer tube 24 until their respective distal position adjustment holes 70 are aligned with the corresponding position adjustment holes 60, 62 of outer tube 24. See FIG. 6. Each inner tube is then locked in place relative to the outer tube by interengaging a respective locking pin 74 with the aligned holes 70 and 62 (FIG. 6) and 70 (obscured), 60 (FIG. 5). Specifically, pin 74 carries a cotter pin 76. A cotter pin 76 is engaged with each inserted pin 74. This locks the inner and outer tubes of each side section longitudinally in place as shown in FIGS. 5 and 6. Each inner tube 26, 28 of each side section 20, 22 is locked in place in the foregoing manner such that frame 12 exhibits its greatest length from front to back. This allows the platform to support ladders that range from 14' to 20' in height. When a ladder of that height is open and mounted on the forward and rearward sections of the frame (as shown in FIG. 1 and described below), the resulting angle formed by the legs of the ladder requires that the side sections of the frame be adjusted to and locked in their maximum, extended length.

A medium frame length for accommodating ladders ranging from 8' to 12' in height is accomplished by adjusting (e.g. slidably extending) and locking in place one corresponding parallel pair of inner tubes (either rearward tubes 26 or forward tubes 28) in the foregoing manner. The other pair of corresponding side section inner tubes are adjusted by sliding those tubes into respective outer tubes 24 such that the proximal position adjustment holes 72 are aligned respectively with a corresponding position adjusting hole 60 or 62 of the outer tube. When such alignment is achieved, the locking pins described above is interengaged with the aligned holes such that the corresponding parallel pair of inner tubes in side sections 20 and 22 are telescopically retracted within their respective outer tubes. Accordingly, one corresponding parallel pair of inner tubes (either the forward or the rearward pair) are retracted and the other pair are extended from opposite ends of the outer tubes. This provides for a medium length frame capable of supporting ladders that range from 8' to 12' in height.

Finally, the smallest frame size is provided by telescopically retracting both inner tubes 26 and 28 of each side section 20, 22 within their respective outer tube 24. In each case, the proximal position adjustment hole 72 of the inner tube is aligned with a respective position adjustment hole 60, 62 of the outer tube. The locking pins and attached cotter pins are engaged in the previously described manner to lock the frame in a condition wherein both side sections maintain their shortest length and the front and back sections of the frame are positioned closest together. This frame size accommodates ladders ranging in height from 4' to 6'.

In each of the foregoing embodiments, alternative forms of locking clips and pins may be employed to hold the frame in a selected size. This permits various sizes of ladders to be carried.

Figure 7:
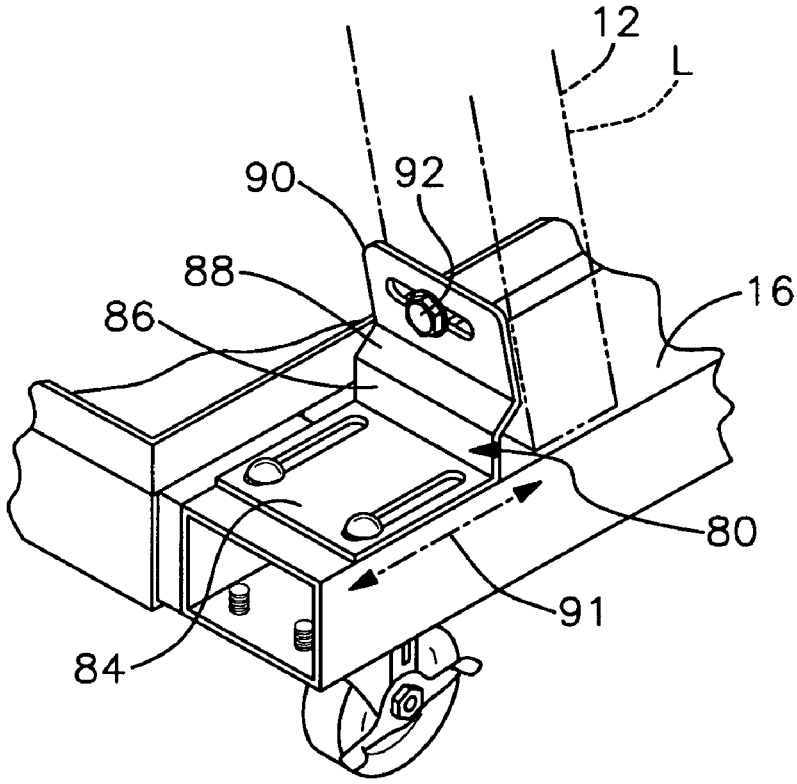
FIG. 7 is a fragmentary perspective view of a representative one of the ladder mounting brackets as connected to a relatively narrow stepladder.
Figure 8:
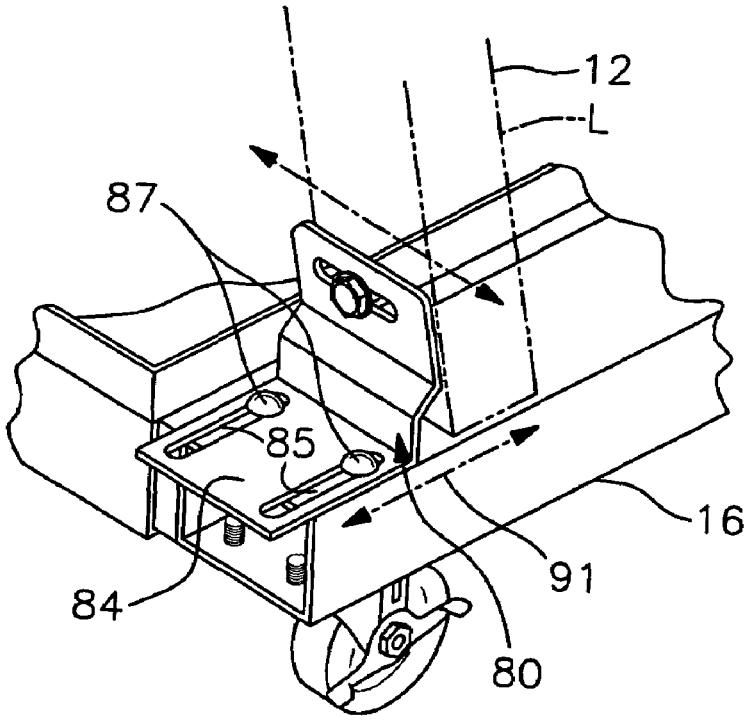
FIG. 8 is a fragmentary perspective end view of the ladder mounting bracket as adjusted outwardly and connected to an associated leg of a relatively wide stepladder.

As shown in FIG. 3, a pair of adjustable mounting brackets 80 and 82 are mounted to each of the front and back frame sections 16 and 18 for securing ladder 12 to platform 10 in the manner shown in FIG. 1. A representative one of the mounting brackets 80 is depicted in FIGS. 7 and 8. It should be understood that the structure and operation described herein apply equally for each of the brackets 80 and 82. Each bracket is associated with and secured to a respective leg of the stepladder supported on platform 10.

Each bracket 80, 82 includes a flat plate 84 that is supported on the upper surface of a respective front or back section of the frame. In FIGS. 7 and 8, plate 84 of representative bracket 80 is mounted on the upper surface of front frame section 16. Plate 84 includes a pair of parallel elongate slots 85 that interengage respective guide bolts 87 mounted to the underlying frame section 16, 18. This allows the mounting brackets to be longitudinally adjusted on their respective underlying frame sections as indicated by doubleheaded arrow 91. A vertical section 86 is attached integrally to plate 84 and extends vertically upwardly therefrom. An angled segment 88 is likewise integrally connected to section 86 and extends upwardly at an angle therefrom. A flange or tab 90 extends upwardly from segment 88 and includes a hole for receiving a connector 92, which may comprise a bolt, screw or other fastening means. This fastener is interengaged with a corresponding aligned hole that is formed in the outside surface of a respective leg L of ladder 12.

Each mounting bracket 80, 82 is associated with a respective leg of ladder 12. Two spaced apart mounting brackets 80, 82 are provided on the front frame section 16 and a similar pair of mounting brackets 80, 82 are provided on the back frame section. Each mounting bracket is longitudinally adjustable along its underlying frame section as previously described and in the direction indicated by doubleheaded arrow 91. The mounting brackets are positioned such that they engage and are secured to respective legs L in the above described manner. Each ladder to be used with the platform is provided with mounting holes in the four legs at a position (height) corresponding to the height of the mounting tab and its hole. The hole formed in each leg L must be alignable with the hole of a corresponding mounting tab 92. The mounting brackets may have alternative configurations within the scope of this invention. Moreover, the brackets may be arranged to be secured to the inside surface of the legs rather then the outside surfaces.

To install a selected ladder 12 on platform 10, the height of the ladder is first ascertained. The size of the frame is then adjusted by lengthening or shortening the side sections 20 and 22, as required, and locking the adjusted side sections in place according to the previously described process. The ladder is then placed upon frame 14 such that the front legs of the ladder engage the upper surface of front frame section 16 and the back legs of the ladder engage the upper surface of the rearward frame section 18. Mounting brackets 80 and 82 are adjusted apart or together, as required, to interengage the respective legs L. For example, if the mounting brackets are initially positioned too narrowly on the frame (i.e. a wider, taller ladder is involved) the brackets are adjusted by sliding them longitudinally outwardly (apart) along the respective frame sections until the mounting tab 90 of each bracket engages the outside surface of a respective ladder leg L. The hole in the mounting tab is aligned with the hole in the ladder leg and an appropriate fastener (e.g. self tapping screw 92 or bolt and nut) is interengaged with the aligned holes. Guide bolts 87 are tightened to hold the mounting bracket securely in place. This operation is performed for each mounting bracket and associated leg. When attachment is completed, the ladder is mounted securely in place on the frame. The side sections are locked in place as previously described and the ladder is ready for use in conjunction with the wheeled platform.

As shown in FIG. 9, a lockable brake 90 is operably mounted to each of the rear wheels 42. Brake 90 is a conventional item comprising a coaster or frictional brake that is turned to lock wheel 42 within its caster housing or yoke 50 so that the wheel does not rotate. Such a brake is provided for each of the rear wheels 42 and may optionally be provided on the front wheels. When the brakes are set, the user may safely ascend and descend the ladder without causing the platform to roll. The wheeled platform and the supportive ladder are held securely and safely in place. The risk and danger of the platform and ladder unintentionally moving are reduced significantly. Potential falls and resulting injuries to the user are much less likely.

In operation, the user selects a ladder appropriate for the project or task involved. The frame is then set for a desired size by adjusting the side sections of the frame longitudinally. The ladder is mounted on the frame and secured thereto by the adjustable mounting brackets 80 and 82. The user may then place appropriate or required tools, equipment and accessories on the base 34. Using the wheeled platform, the worker is able to quickly and conveniently move and reposition the ladder between desired work locations. The wheeled platform and supported ladder are rolled effortlessly between successive locations. The swivel wheels permit the apparatus to be turned precisely and immediately. At each work location, the user first secures the apparatus in place by locking the rear wheels. The worker then climbs the ladder, performs the desired task (e.g. painting, changing light bulbs, fire alarms, etc.) and then descends the ladder, all in a quick, convenient and safe fashion. The brakes are then unlocked and the wheeled platform and supported ladder are moved quickly and conveniently to the next location. The user is able to transport his or her work belt, as well as any required accessories and tools conveniently on the base of the platform so that repeated inconvenient and time-consuming trips between work locations are avoided. The user no longer has to manually carry a bulky ladder or accompanying tools and equipment between work locations. This helps to reduce back strain and other lifting relating injuries.

The present invention is particularly effective for use in venues such as warehouses, construction sites and other locations where a ladder must be constantly moved and repositioned. The apparatus is particularly appropriate for use by paint contractors, fire alarm installers, electricians and maintenance personnel.

From the foregoing it may be seen that the apparatus of this invention provides for a wheeled platform for supporting a stepladder and, more particularly, to a platform that allows a stepladder to be conveniently maneuvered and moved between successive selected locations without requiring the user to fold, carry and unfold the ladder. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A wheeled platform for supporting a stepladder, which stepladder has a pair of front legs and a pair of back legs hingedly connected to the front legs, with the stepladder in an open condition, said platform comprising:

a horizontally alignable frame that carries a plurality of adjustable mounting brackets for attaching respective legs of the stepladder to said frame; said frame having a generally rectangular shape with an adjustable size for accommodating selected sizes of stepladders, said frame including a pair of elongate and substantially parallel forward and rearward frame sections and a pair of elongate and substantially parallel side frame sections that interconnect said forward and rearward frame sections proximate respective ends thereof; each of said forward and rearward frame sections being longitudinally fixed and having a nonadjustable length, said forward frame section being directly engaged by lower ends of the front legs of the stepladder and said rearward frame section being directly engaged by lower ends of the back legs of the stepladder; said forward frame section carrying a first pair of said mounting brackets, which are spaced apart for interconnecting to respective front legs of the stepladder, said rearward frame section including a second pair of said mounting brackets, which are spaced apart for attaching to respective back legs of the stepladder; each said mounting bracket being positionally adjustable longitudinally relative to a respective one of said forward and rearward frame sections and laterally relative to the direction in which the stepladder opens for engaging a respective leg of the stepladder;

a plurality of wheels rotatably and swivelably mounted to and depending from said frame for engaging an underlying surface to move said frame and a stepladder supported by said frame along the underlying surface; and a brake selectively engagable with at least one of said wheels for braking movement of said frame along the underlying surface; wherein, each said mounting bracket includes a plate mounted to an associated one of said forward and rearward frame sections; each said plate including one or more longitudinal slots receiving one or more associated positioning bolts engaged with said frame, said mounting brackets for sliding longitudinally along said associated frame sections such that said positioning bolts slide relatively within said slots; each said mounting bracket further including an upwardly turned flange attached to said plate and including an engagement hole formed therethrough, said flange engaging a respective leg of the ladder such that a connector is insertable through said engagement hole in the flange and engageable with a leg of the ladder to attach said mounting bracket to the ladder; said mounting brackets are adjustable perpendicularly relative to the direction in which said stepladder opens and closes; said forward and rearward frame sections and said side frame sections include square tubing components; each side frame section square tubing component comprising an outer tube and a pair of inner tubes; one of said pair of inner tubes having an end attached to the forward frame section and an opposite free end telescopically engaged within one end of the outer tube and the other of said pair of inner tubes having an end attached to the rearward frame section and an opposite free end telescopically engaged within another end of the outer tube; the inner and outer tubes are longitudinally slidable with respect to one another to adjust the lengths of said side frame sections and the distance between the forward and rearward frame sections; further including a base having upwardly turned lip that extends peripherally about said base in which said base is attached to said outer tubes and extending across said frame for supporting work items thereon.

2. The platform of claim 1 in which said telescopically interengaged members include respective alignable openings and further including a locking pin for interengaging said openings when said openings are aligned to fasten the telescopically interconnected side frame sections in a selected position.

3. The platform of claim 1 in which said wheels include casters formed at respective corners of the rectangular frame.

* * * * *